US008939554B2

(12) United States Patent
Nagahata

(10) Patent No.: US 8,939,554 B2
(45) Date of Patent: Jan. 27, 2015

(54) INK JET PRINT HEAD AND FABRICATION METHOD THEREOF

(71) Applicant: Rohm Co., Ltd., Kyoto (JP)

(72) Inventor: Takaya Nagahata, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 13/857,128

(22) Filed: Apr. 4, 2013

(65) Prior Publication Data

US 2013/0265370 A1 Oct. 10, 2013

(30) Foreign Application Priority Data

Apr. 5, 2012 (JP) ..... 2012-086783

(51) Int. Cl.
*B41J 2/045* (2006.01)
*B41J 2/14* (2006.01)

(52) U.S. Cl.
CPC ..... *B41J 2/045* (2013.01); *B41J 2/14201* (2013.01); *B41J 2/14233* (2013.01); *B41J 2202/11* (2013.01)
USPC ..... 347/68

(58) Field of Classification Search
None
See application file for complete search history.

(56) References Cited

U.S. PATENT DOCUMENTS 6,336,717 B1 * 1/2002 Shimada et al. ..... 347/71
2011/0109701 A1 * 5/2011 Ohashi ..... 347/68

FOREIGN PATENT DOCUMENTS

JP 2008-012706 A 1/2008

* cited by examiner

*Primary Examiner* — Matthew Luu
*Assistant Examiner* — Erica Lin
(74) *Attorney, Agent, or Firm* — Rabin & Berdo, P.C.

(57) ABSTRACT

An ink jet print head includes a substrate in which a pressure chamber is formed, a vibration film configured to define the pressure chamber and deformed to change a volume of the pressure chamber, a lower electrode formed on the vibration film, a piezoelectric film formed on the lower electrode, and an upper electrode formed on the piezoelectric film and having a periphery receding inwardly relative to a periphery of the piezoelectric film.

12 Claims, 11 Drawing Sheets

INK JET PRINT HEAD AND FABRICATION METHOD THEREOF

CROSS-REFERENCE TO RELATED APPLICATION(S)

This application is based upon and claims the benefit of priority from Japanese Patent Application No. 2012-86783, filed on Apr. 5, 2012, the entire contents of which are incorporated herein by reference.

TECHNICAL FIELD

The present disclosure relates to an ink jet print head discharging ink by changing the volume of an ink flow channel through a piezoelectric element and a fabrication method thereof.

BACKGROUND

Ink jet type recording heads include a nozzle substrate, an ink chamber substrate, a vibration plate, and a piezoelectric element bonded to the vibration plate. A pressure chamber to which ink is introduced is formed in the ink chamber substrate, and the vibration plate is in contact with the pressure chamber. The piezoelectric element is formed by laminating a lower electrode, a piezoelectric layer, and an upper electrode on the vibration plate.

In some ink jet type recording heads , the lower electrode, the piezoelectric layer, and the upper layer constituting the piezoelectric element are provided in a region facing the pressure chamber with the vibration plate interposed therebetween, so that they are formed to have the same pattern and have the same shape and size.

A piezoelectric material used to form the piezoelectric layer is, for example, a metal oxide represented by PZT ($PbZr_xTi_{1-x}O_3$). Such a piezoelectric material is formed of sintered compounds of crystal grains, and in performing etching to pattern the piezoelectric layer, the piezoelectric layer is cut up by the crystal grains or the material constituting the piezoelectric layer is being removed as the crystal grains are attached. For this reason, an end surface of the piezoelectric layer after patterning is performed has depressions and protrusions, rather than a smooth surface. Therefore, when a driving voltage (e.g., 30V to 40V) is applied between the upper electrode and the lower electrode disposed with the piezoelectric layer interposed therebetween, sparks are generated to cause a short-circuit between the upper electrode and the lower electrode. In particular, when the piezoelectric layer is formed as an extremely thin layer having a thickness of about 2 μm, the spark problem between the upper electrode and the lower electrode becomes particularly noticeable.

SUMMARY

The present disclosure provides some embodiments of an ink jet print head in which a short-circuit between an upper electrode and a lower electrode disposed with a piezoelectric film interposed therebetween is restrained to improve driving characteristics, and a fabrication method thereof.

According to one embodiment of the present disclosure, an ink jet print head is provided, the ink jet print head including a substrate in which a pressure chamber is formed; a vibration film configured to define the pressure chamber and deformed to change a volume of the pressure chamber; a lower electrode formed on the vibration film; a piezoelectric film formed on the lower electrode; and an upper electrode formed on the piezoelectric film and having a periphery receding inwardly relative to a periphery of the piezoelectric film.

With this configuration, the periphery of the upper electrode inwardly recedes, relative to the periphery of the piezoelectric film, and thus, a distance from the upper electrode to the lower electrode is increased. Further, when the upper electrode is patterned such that the periphery of the upper electrode recedes inwardly relative to the periphery of the piezoelectric film, a peripheral portion of the piezoelectric film is exposed, and therefore, the peripheral portion of the piezoelectric film is simultaneously processed. As a result, depressions and protrusions (i.e., unevenness) at an end surface of the piezoelectric film are reduced. Accordingly, a spark (short-circuit) between the upper electrode and the lower electrode can be restrained.

The vibration film constitutes, for example, a ceiling wall of the pressure chamber, and a piezoelectric element is formed by the lower electrode, the piezoelectric film, and the upper electrode laminated on the vibration film. The vibration film may be deformed by driving the piezoelectric element by applying a driving voltage between the upper electrode and the lower electrode, whereby the volume of the pressure chamber may be varied. Thus, when ink is introduced into the pressure chamber, an amount of ink corresponding to the change in the volume of the pressure chamber can be discharged.

In the embodiment, the piezoelectric film has an end surface having a tapered shape receding inwardly toward the upper electrode from the lower electrode.

The end surface having the tapered shape is formed as the peripheral portion of the piezoelectric film is exposed in patterning the upper electrode such that it recedes inwardly relative to the periphery of the piezoelectric film so the corresponding peripheral portion is processed. Accordingly, the end surface having the tapered shape is smooth with reduced depressions and protrusions. Also, the distance between the upper electrode and the lower electrode is increased in comparison to a case in which the end surface of the piezoelectric film is perpendicular to a main surface of the piezoelectric film. Accordingly, a spark (short-circuit) between the upper electrode and the lower electrode can be restrained.

In the embodiment, the piezoelectric film is configured as sintered compounds of metal oxide crystal grains.

When the piezoelectric film formed of sintered compounds of metal oxide crystal grains are etched to be patterned, the crystal grains thereof may be detached from the end surface of the piezoelectric film or may further be re-attached to the end surface of the piezoelectric film, so the end surface of the piezoelectric film may have depressions and protrusions. The depressions and protrusions of the end surface are removed in patterning the upper electrode, and spark (short-circuit) between the upper electrode and the lower can be restrained.

In the embodiment, the vibration film has a rectangular shape, and the piezoelectric film is longer than the vibration film with respect to a length direction of the vibration film, and an end portion of the piezoelectric film extends to an outer side of the vibration film, beyond an end portion of the vibration film in the length direction.

With this configuration, the vibration film may be prevented from being significantly bent due to a weight of the piezoelectric film. If one end portion or both end portions of the piezoelectric film is/are positioned inwardly relative to an end portion of the vibration film (an end portion of the pressure chamber), the vibration film is bent due to the weight of the piezoelectric film. Then, a change in the volume of the pressure chamber made when the piezoelectric film is driven by applying a voltage between the upper electrode and the lower electrode is reduced, degrading ink discharge performance. In comparison, when the end portion of the piezoelectric film extends to an outer side of the vibration film (an outer side of the pressure chamber) beyond the end portion of the vibration film (the end portion of the pressure chamber), the end portion of the piezoelectric film is supported by the substrate in a region outside the pressure chamber. The piezoelectric film is supported by rigidity thereof and does not apply a significant load to the vibration film. Thus, a degree of bending of the vibration film is reduced when the piezoelectric element is not driven. Accordingly, when a driving voltage is applied between the upper electrode and the lower electrode, the vibration film is greatly displaced and the volume of the pressure chamber can be greatly varied, improving ink discharge performance.

In the embodiment, the piezoelectric film has an equal width rectangular portion extending in the length direction of the vibration film, the equal width rectangular portion is longer than the length of the vibration film in the length direction, and both end portions of the equal width rectangular portion are positioned at an outer side of the vibration film, beyond both end portions of the vibration film in the length direction.

The equal width rectangular portion refers to a rectangular portion in which a width perpendicular to the length direction is uniform in the length direction.

With this configuration, both end portions of the equal rectangular portion of the piezoelectric film are positioned at an outer side of the vibration film beyond the both end portions of the vibration film. Thus, a degree of bending of the vibration film resulting from the weight of the piezoelectric film can further be reduced. Accordingly, the volume of the pressure chamber can be greatly varied, further enhancing the ink discharge performance.

In the embodiment, the upper electrode is shorter than the vibration film with respect to the length direction of the vibration film, and an end portion of the upper electrode is disposed at an inner side of the vibration film, relative to the both end portions of the vibration film in the length direction.

With this configuration, since a driving voltage may be applied between the upper electrode and the lower electrode in an internal region of the vibration film, the piezoelectric film can be effectively deformed in a region facing the vibration film. Thus, the vibration film can be greatly displaced. As a result, since the volume of the pressure chamber is greatly varied, ink discharge performance can be enhanced.

In the embodiment, a space is provided between the periphery of the piezoelectric film and a lateral side along the length direction of the vibration film.

With this configuration, since the vibration film is not constrained by the piezoelectric film in the region corresponding to the space between the periphery of the piezoelectric film and the side edge along the length direction of the vibration film, the vibration film can be greatly deformed. Thus, since the vibration film can be greatly displaced when a voltage is applied to the piezoelectric film, the volume of the pressure chamber can be greatly changed to enhance the ink discharge performance.

According to another embodiment of the present disclosure, a method for fabricating an ink jet print head is provided, the method including preparing a substrate; forming a lower electrode film on the substrate; forming a piezoelectric material film laminated on the lower electrode film; forming an upper electrode film laminated on the piezoelectric material film; patterning the lower electrode film, the piezoelectric material film, and the upper electrode film by a lower electrode pattern to form a lower electrode; patterning the upper electrode film and the piezoelectric material film by a piezoelectric film pattern different from the lower electrode pattern to form a piezoelectric film; patterning the upper electrode film by an upper electrode pattern having a periphery receding inwardly from a periphery of the piezoelectric film to form an upper electrode; and etching portions of the substrate facing the lower electrode, the piezoelectric film, and the upper electrodes from an opposite side of the piezoelectric film to form a pressure chamber facing the lower electrode, the piezoelectric film, and the upper electrode, and forming a vibration film made of a portion of the substrate between the lower electrode and the pressure chamber.

With this method, after the lower electrode film, the piezoelectric material film, and the upper electrode film are all patterned by the lower electrode pattern; the upper electrode film and the piezoelectric material film are patterned by the piezoelectric film pattern; and further, the upper electrode film is patterned by the upper electrode pattern having the periphery receding inwardly from the periphery of the piezoelectric film. In patterning the piezoelectric material film, an end surface of the piezoelectric material film is not necessarily smooth but has a possibility of depressions and protrusions. However, since a peripheral portion of the piezoelectric film is exposed in patterning the upper electrode film, the peripheral portion can be processed. As a result, the end surface of the piezoelectric film is smoothened. In this manner, since the periphery of the upper electrode pattern recedes inwardly relative to the periphery of the piezoelectric film, the distance between the periphery of the upper electrode and the periphery of the lower electrode is lengthened and the piezoelectric film has a smooth end surface. As a result, spark (short circuit) between the upper electrode and the lower electrode can be restrained.

In the embodiment, in patterning the upper electrode film by the upper electrode film pattern, an end surface of the piezoelectric film is shaped as a tapered surface receding inwardly toward the upper electrode from the lower electrode.

In the embodiment, the piezoelectric film is configured as sintered compounds of metal oxide crystal grains.

In the embodiment, the vibration film has a rectangular shape, and the piezoelectric film and the pressure chamber are formed such that the piezoelectric film is longer than the vibration film with respect to a length direction of the vibration film, and an end portion of the piezoelectric film extends to an outer side of the vibration film, beyond an end portion of the vibration film in the length direction.

In the embodiment, the upper electrode and the pressure chamber are formed such that the upper electrode is shorter than the vibration film with respect to the length direction of the vibration film, and an end portion of the upper electrode is disposed at an inner side of the vibration film, relative to the both end portions of the vibration film in the length direction.

In the embodiment, the piezoelectric film and the pressure chamber are formed such that a space is provided between the periphery of the piezoelectric film and a lateral side along length direction of the vibration film.

DETAILED DESCRIPTION

A first embodiment of the present disclosure will now be described in detail with reference to the drawings.

Figure 1:
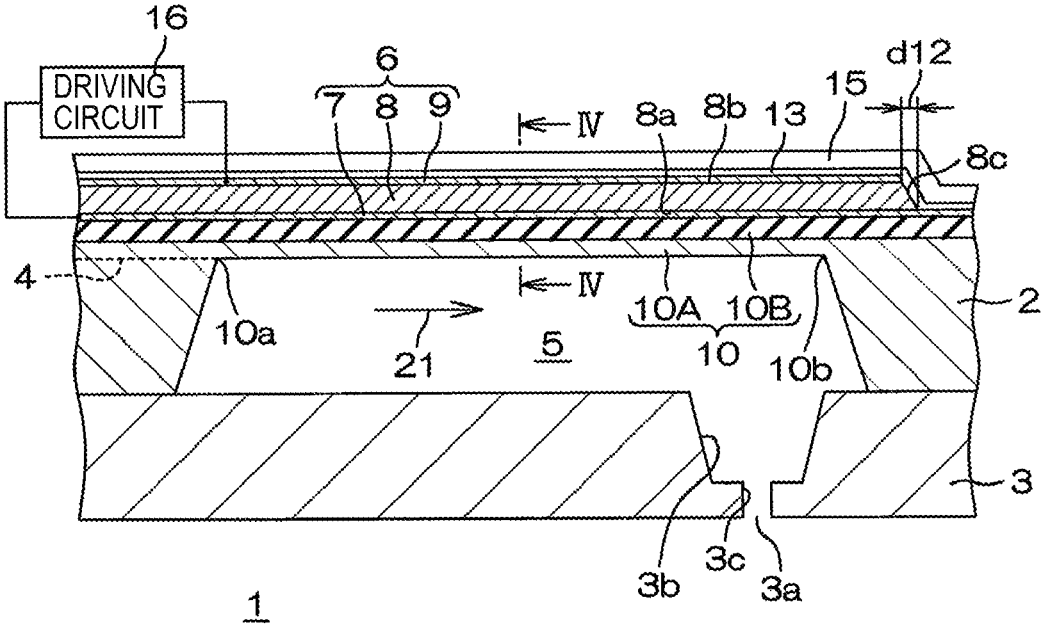
FIG. 1 is a schematic cross-sectional view of an ink jet print head according to a first embodiment of the present disclosure.

FIG. 1 is a schematic cross-sectional view of an ink jet print head according to a first embodiment of the present disclosure. An ink jet print head 1 includes a silicon substrate 2 as an example of a substrate and a nozzle substrate 3 having a discharge opening 3*a* for discharging ink.

In the silicon substrate 2, a pressure chamber 5 as an ink flow channel (ink reservoir) is formed in a rear side (the nozzle substrate 3 side). The nozzle substrate 3 is formed of, for example, a silicon plate and attached to a rear surface of the silicon substrate 2, and defines the pressure chamber 5 together with the silicon substrate 2. The nozzle substrate 3 has a recess portion 3*b* connected to the pressure chamber 5, and an ink discharge passage 3*c* is formed on a lower surface of the recess portion 3*b*. The ink discharge passage 3*c* penetrates the nozzle substrate 3 and has the discharge opening 3*a* in the opposite side of the pressure chamber 5. Thus, when the volume of the pressure chamber 5 is varied, ink maintained in the pressure chamber 5 is discharged from the discharge opening 3*a* through the ink discharge passage 3*c*.

The pressure chamber 5 is formed by digging the silicon substrate 2 from a rear side. In the silicon substrate 2, an ink supply path 4 (see FIG. 4 as a cross-section taken along line IV-IV of FIG. 1, together) that communicates with the pressure chamber 5 is formed. The ink supply path 4 communicates with the pressure chamber 5 and is formed to induce ink from an ink tank (e.g., an ink cartridge) as an ink source to the pressure chamber 5.

The pressure chamber 5 has an elongated shape extended in an ink distribution direction 21 that is a horizontal direction in FIG. 1. A ceiling wall of the pressure chamber 5 forms a vibration film 10. The vibration film 10 is formed by laminating a silicon layer 10A that is a portion of the silicon substrate 2 and a silicon oxide ($SiO_2$) layer 10B that is an insulating film. In this embodiment, the silicon oxide layer 10B is formed on an entire surface of the silicon substrate 2, as well as in an upper side of the pressure chamber 5. However, in the present disclosure, the "vibration film 10" refers to a ceiling wall portion defining the pressure chamber 5. Thus, the silicon oxide layer 10B outside of the pressure chamber 5 does not constitute the vibration film 10.

A thickness of the vibration film 10 ranges from, for example, 0.4 μm to 2 μm. More specifically, a thickness of the silicon layer 10A ranges from, for example, 0.3 μm to 1.4 μm, and a thickness of the silicon oxide layer 10B ranges from, for example, 0.1 μm to 0.6 μm. The pressure chamber 5 is formed by partially etching the silicon substrate 2 from the rear side. The silicon layer 10A is formed by leaving a thin portion of the silicon substrate 2 in a ceiling portion of the pressure chamber 5. In other words, the silicon substrate 2 includes a thick portion (having a thickness ranging from 50 μm to 300 μm) formed in a portion other than the pressure chamber 5 and a thin portion as the ceiling portion of the pressure chamber 5. The thin portion forms the silicon layer 10A constituting the vibration film 10. The pressure chamber 5 is defined by the vibration film 10, the thick portion of the silicon substrate 2, and the nozzle substrate 3. In this embodiment, the pressure chamber 5 is formed to have a substantially rectangular parallelepiped shape. A length of the pressure chamber 5 may be, for example, about 500 μm, and a width thereof may be about 50 μm. However, since the pressure chamber 5 is formed by performing etching on the rear portion of the silicon substrate 2, lateral surfaces thereof may be tapered to be narrowed toward an upper surface (inwardly sloped surfaces, see FIG. 4 together). The ink supply path 4 communicates with one end portion of the pressure chamber 5 in a length direction (in this embodiment, an end portion positioned in an opposite side of the discharge opening 3*a*). In this embodiment, the discharge opening 3*a* of the nozzle substrate 3 is disposed near the other end portion of the pressure chamber 5 in the length direction.

A piezoelectric element 6 is disposed on a surface of the vibration film 10, i.e., on a surface of the silicon oxide layer 10B. The piezoelectric element 6 includes a lower electrode 7 formed on the silicon oxide layer 10B, a piezoelectric film 8 formed on the lower electrode 7, and an upper electrode 9 formed on the piezoelectric film 8. In other words, the piezoelectric element 6 is configured by the upper electrode 9, the lower electrode 7, and the piezoelectric film 8 interposed therebetween.

The lower electrode 7 has, for example, a dual-layer structure in which a titanium (Ti) layer and a platinum (Pt) layer are sequentially laminated on the vibration film 10. Besides, the lower electrode 7 may also be formed as a single film such as a gold (Au) film, a chromium (Cr) film, or a nickel (Ni) film. The lower electrode 7 is disposed to be in contact with a lower surface of the piezoelectric film 8. The lower electrode 7 may have an extended portion that extends to an outer region of the piezoelectric film 8.

As the piezoelectric film 8, a PZT ($PbZr_xTi_{1-x}O_3$) film formed through, for example, a sol-gel method or a sputtering method may be used. The piezoelectric film 8 is formed as sintered compounds of metal oxide crystal. A thickness of the piezoelectric film 8 may preferably range from 1 μm to 5 μm. Preferably, an overall thickness of the vibration film 10 may be equal to that of the piezoelectric film 8, or may be two-thirds (⅔) of the thickness of the piezoelectric film 8.

The upper electrode 9 is formed to have a shape almost similar to that of the piezoelectric film 8 when viewed from a plane (i.e., from a thickness direction of the piezoelectric film 8). More specifically, a periphery of the upper electrode 9 recedes inwardly by a predetermined distance (e.g., approximately 2.5 μm) relative to a periphery of the piezoelectric film 8. Thus, the upper electrode 9 is smaller than the piezoelectric film 8. The upper electrode 9 has, for example, a triple-layer structure in which an iridium oxide ($IrO_2$) layer and an iridium (Ir) layer are sequentially laminated on the piezoelectric film 8 and a platinum (Pt) layer, a gold (Au) layer, or the like is additionally laminated.

Surfaces of the vibration film 10 and the piezoelectric element 6 are covered by a hydrogen barrier film 13. The hydrogen barrier film 13 is made of, for example, an aluminum oxide ($Al_2O_3$). Thus, a degradation of characteristics of the piezoelectric film 8 due to hydrogen reduction can be prevented. A surface protective film 15 is formed on the hydrogen barrier film 13 in order to protect an outermost surface of the ink jet print head 1. The surface protective film 15 is made of, for example, SiN.

The piezoelectric element 6 is formed at a position facing the pressure chamber 5 with the vibration film 10 interposed therebetween. In other words, the piezoelectric element 6 is formed to be in contact with a surface of the vibration film 10 opposite to the pressure chamber 5. The pressure chamber 5 is charged with ink supplied through the ink supply path 4 from an ink tank (not shown). The vibration film 10 defines the ceiling portion of the pressure chamber 5 and is in contact with the pressure chamber 5. The vibration film 10 is supported by a surrounding portion (thick portion) of the pressure chamber 5 of the silicon substrate 2, and has flexibility such that it is deformable in a direction toward the pressure chamber 5 (in other words, in a thickness direction of the vibration film 10).

The lower electrode 7 and the upper electrode 9 are connected to a driving circuit 16. The driving circuit 16 may be formed in a region different from the pressure chamber 5 of the silicon substrate 2 or may be formed outside the silicon substrate 2. When a driving voltage is applied from the driving circuit 16 to the piezoelectric element 6, the piezoelectric film 8 is deformed by an inverse piezoelectric effect. Accordingly, the vibration film 10 is deformed together with the piezoelectric element 6, causing the volume of the pressure chamber 5 to be changed to pressurize ink within the pressure chamber 5. The pressurized ink is discharged as a micro-droplet from the discharge opening 3*a* through the ink discharge passage 3*c*.

Figure 2:
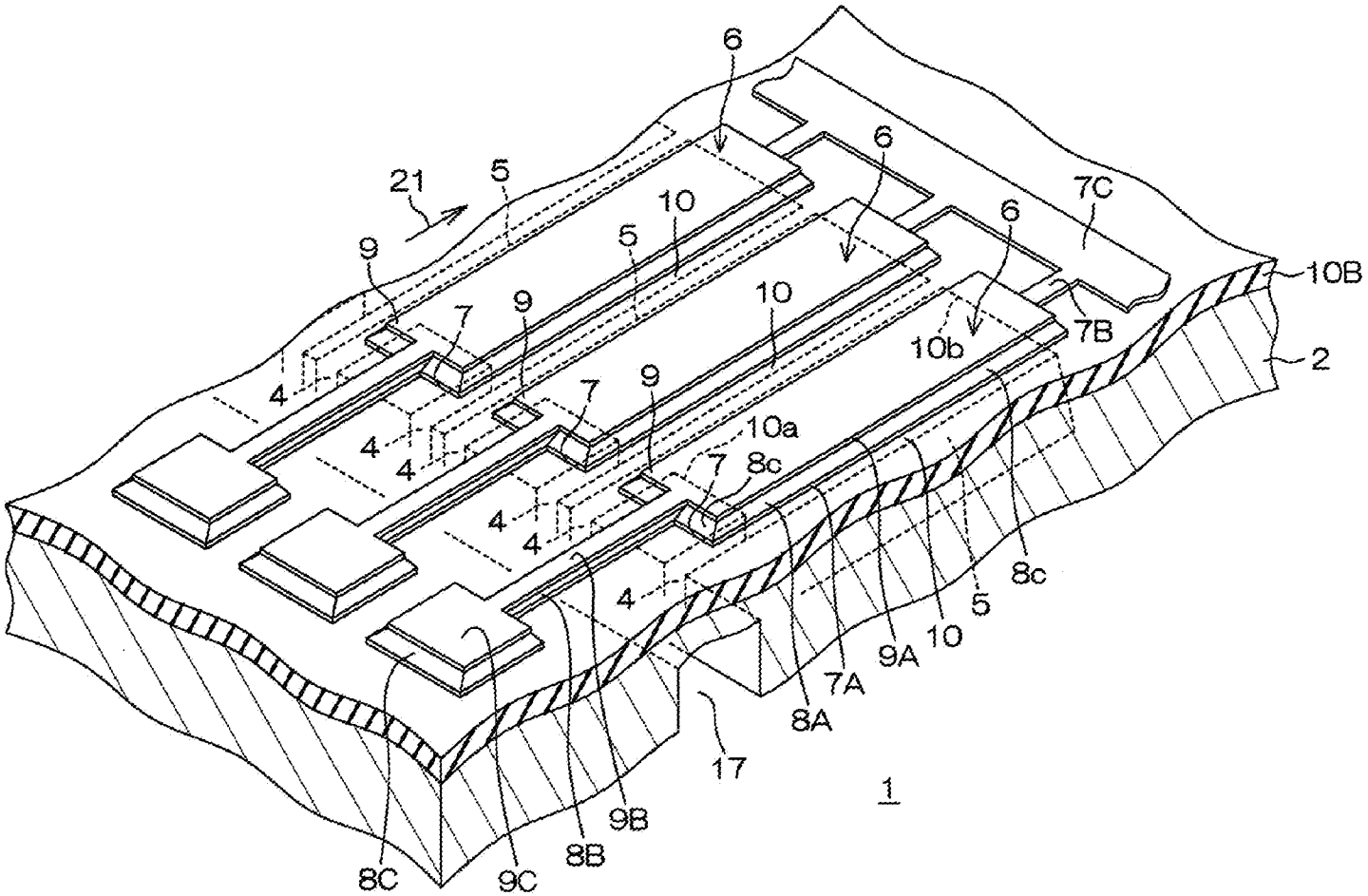
FIG. 2 is a schematic perspective view illustrating a layout of a pressure chamber and a piezoelectric element.
Figure 3:
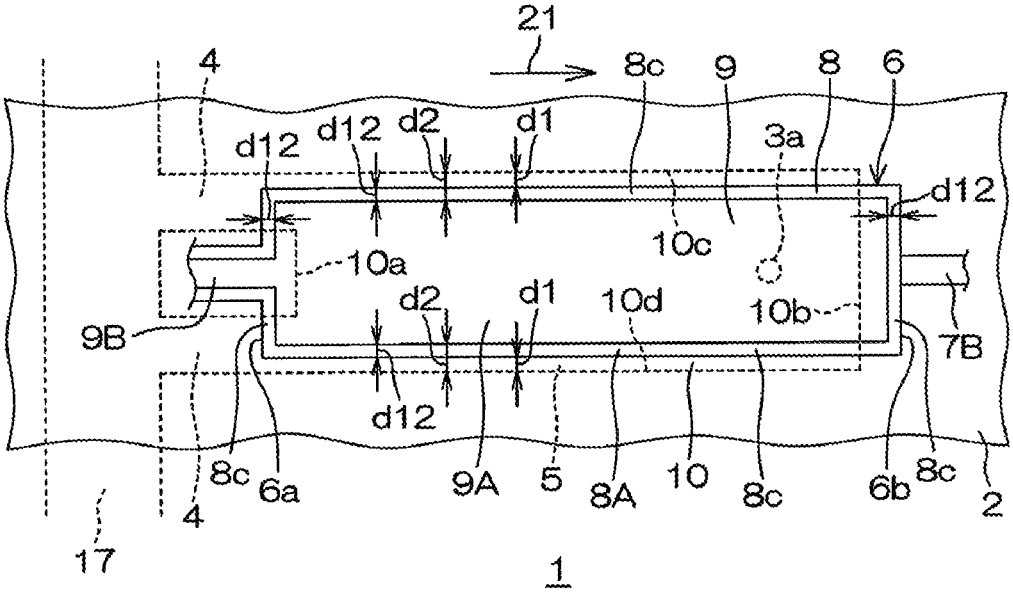
FIG. 3 is a schematic plan view illustrating the layout of the pressure chamber and the piezoelectric element.
Figure 4:
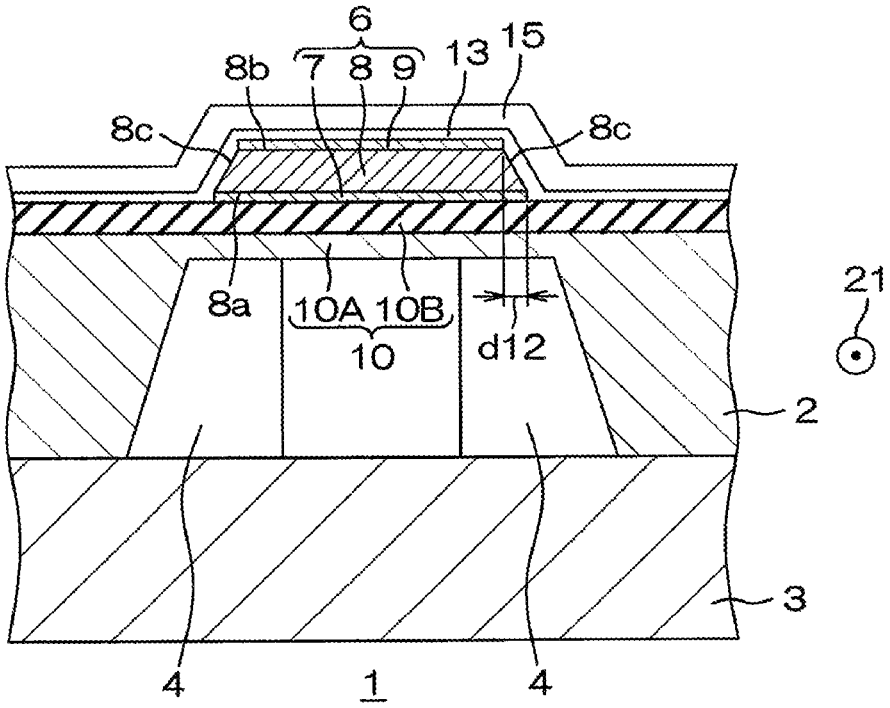
FIG. 4 is a cross-sectional view of a cross-section taken in a direction perpendicular to a length direction of the pressure chamber.

FIG. 2 is a schematic perspective view illustrating a layout of the pressure chamber 5 and the piezoelectric element 6, and FIG. 3 is a schematic plan view of a portion thereof. Further, FIG. 4 is a cross-sectional view of a cross-section (cross-section taken along line IV-IV in FIG. 1) taken in a direction perpendicular to a length direction of the pressure chamber 5.

A plurality of pressure chambers 5 extends to be parallel to each other on the silicon substrate 2. The plurality of pressure chambers 5 are formed at equal intervals by micro-intervals (e.g., approximately 15 μm) in a width direction thereof. The respective pressure chambers 5 have a rectangular shape extending along the ink distribution direction 21 (see FIG. 1 together) directing toward the ink discharge passage 3*c* from the ink supply path 4 when viewed from the plane. Two ink supply paths 4 are formed in one end portion of the pressure chamber 5 and communicate with a common ink passage 17. The common ink passage 17 communicates with the ink supply paths 4 corresponding to the plurality of pressure chambers 5, and is formed to supply ink to the ink supply paths 4 from the ink tank.

The piezoelectric element 6 is formed to be longer than the vibration film 10 constituting a ceiling wall of the pressure chamber 5 along the ink distribution direction 21 (the same direction as the length direction of the vibration film 10), and has a rectangular shape when viewed from the plane. A first end side 6*a* of the piezoelectric element 6 is disposed at an outer side of the vibration film 10 with respect to the length direction of the vibration film 10. A second end side 6*b* of the piezoelectric element 6 is disposed at an outer side of the vibration film 10 with respect to the length direction of the vibration film 10. In other words, the piezoelectric element 6 extends beyond both end sides 10*a* and 10*b* of the corresponding vibration film 10 along the length direction of the vibration film 10, and the both end sides 6*a* and 6*b* are positioned at mutually opposite sides with respect to the length direction of the vibration film 10. Further, the piezoelectric element 6 is formed such that a width thereof in a width direction (direction parallel to a main surface of the silicon substrate 2) perpendicular to the length direction of the vibration film 10 is narrower than a width of the vibration film 10 (i.e., the pressure chamber 5) in the width direction. And, both lateral sides 6*c* and 6*d* along the length direction of the piezoelectric element 6 are disposed at an inner side by a predetermined interval d1 (e.g., approximately 2.5 μm) with respect to both lateral sides 10*c* and 10*d* of the vibration film 10 corresponding thereto.

More specifically, the lower electrode 7 includes an equal width rectangular portion 7A constituting the piezoelectric element 6, a lead-out electrode portion 7B integrated with the equal width rectangular portion 7A and led out from the piezoelectric element 6, and a common connection portion 7C for commonly connecting the lower electrodes 7 of the plurality of piezoelectric elements 6. The equal width rectangular portion 7A is formed to be longer than the vibration film 10 along the length direction of the vibration film 10, and both end portions thereof reach an outer side, beyond both end sides 10*a* and 10*b* of the vibration film 10 in the length direction (see FIG. 2). Also, it is formed such that a width of the equal width rectangular portion 7A in the width direction of the vibration film 10 is narrower than a width of the vibration film 10 in the width direction, and both lateral sides thereof are disposed at an inner side by a predetermined interval dl therebetween with respect to the both lateral sides 10*c* and 10*d* corresponding to the vibration film 10. The lead-out electrode portion 7B is led out along the length direction of the piezoelectric element 6 in the vicinity of the center of the second end side 6*b* of the piezoelectric element 6 (see FIG. 3). Meanwhile, the "equal width rectangular portion" refers to a rectangular portion in which widths thereof perpendicular in the length direction are uniform in the length direction. This is the same hereinafter.

The upper electrode 9 includes an equal width rectangular portion 9A constituting the piezoelectric element 6, a lead-out electrode portion 9B integrated with the equal width rectangular portion 9A and led out from the piezoelectric element 6, and a pad portion 9C led out for an external connection and having a width greater than that of the electrode portion 9B. The equal width rectangular portion 9A is formed to be longer than the vibration film 10 along the length direction of the vibration film 10, and both end portions thereof reach an outer side, beyond both end sides 10*a* and 10*b* of the vibration film 10 in the length direction. Also, the equal width rectangular portion 9A is formed such that a width thereof along the width direction of the vibration film 10 is narrower than that of the vibration film 10 in the width direction, and both lateral sides thereof are disposed at an inner side by an interval d2 (e.g., approximately 2 μm to 5 μm) slightly greater than the interval dl with respect to the both lateral sides 10*c* and 10*d* of the vibration film 10. The lead-out electrode portion 9B is led out to the opposite side of the lower electrode 7 along the length direction of the piezoelectric element 6 in the vicinity of the center of the first end side 6*a* of the piezoelectric element 6.

The piezoelectric film 8 is formed to have an almost same pattern as that of the upper electrode 9. In other words, the piezoelectric film 8 includes an equal width rectangular portion 8A constituting the piezoelectric element 6, a lead-out portion 8B integrated with the equal width rectangular portion 8A and positioned under the lead-out electrode portion 9B of the upper electrode 9, and a lower pad portion 8C positioned under the pad portion 9C of the upper electrode 9. The equal width rectangular portion 8A is formed to be longer than the vibration film 10 along the length direction of the vibration film 10, and both end portions thereof reach an outer side thereof, beyond the both end sides 10*a* and 10*b* of the vibration film 10. Also, the equal width rectangular portion 8A is formed such that a width thereof according to the width direction of the vibration film 10 is narrower than the width of the vibration film 10 in the width direction and both lateral sides thereof are disposed at an inner side by the interval d1 with respect to the both lateral sides 10*c* and 10*d* of the vibration film 10 corresponding thereto.

The piezoelectric film 8 has a lower surface 8*a* in contact with the lower electrode 7 and an upper surface 8*b* in contact with the upper electrode 9 (see FIG. 4). The piezoelectric film 8 has the lower surface 8*a* having a pattern almost same as that of the lower electrode 7 in a portion in contact with the lower electrode 7. More specifically, the lower surface 8*a* of the equal width rectangular portion 8A of the piezoelectric film 8 has a pattern almost same as that of the equal width rectangular portion 7A of the lower electrode 7. Further, the piezoelectric film 8 has the upper surface 8*b* having a pattern almost same as that of the upper electrode 9. More specifically, the upper surface 8*b* of the equal width rectangular portion 8A of the piezoelectric film 8 has a pattern almost same as that of the equal width rectangular portion 9A of the upper electrode 9. A periphery of the upper electrode 9 is positioned at an inner side by a predetermined distance d12 (=d2-d1, for example, approximately 1 μm to 3 μm) than a periphery of the lower electrode 7. For this reason, the periphery of the upper surface 8*b* of the piezoelectric film 8 is positioned at an inner side of the periphery of the lower surface 8*a*. As a result, the end surface 8*c* of the piezoelectric film 8 forms a sloped surface (a tapered surface) sloped inwardly toward the upper surface 8*b* from the lower surface 8*a*. A periphery of the piezoelectric film 8 is defined by a periphery of the lower surface 8*a* positioned at an outer side than a periphery of the upper surface 8*b*. Thus, the periphery of the upper electrode 9 is positioned at an inner side only by a distance d12 than the periphery of the piezoelectric film 8.

Figure 5:
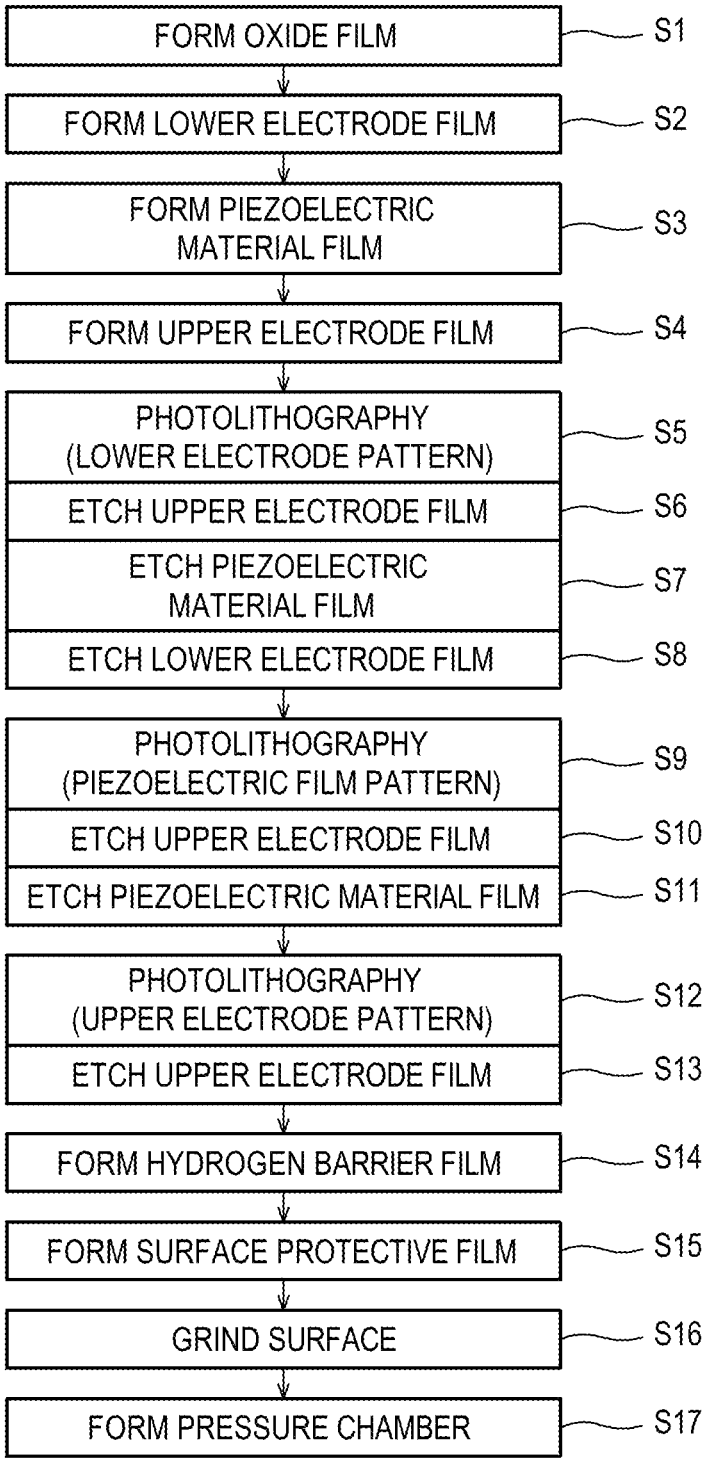
FIG. 5 is a view illustrating an example of a process of fabricating the ink jet print head.

FIG. 5 is a view illustrating an example of a process of fabricating the ink jet print head 1. First, a silicon oxide layer 10B is formed on a surface of the silicon substrate 2 (S1). The silicon oxide layer 10B may be formed through a thermal oxidation method. A film thickness of the silicon oxide layer 10B may range, for example, from 1000 to 4000. A base oxide film such as, for example, $Al_2O_3$, MgO, or $ZrO_2$ may be formed on a surface of the silicon oxide layer 10B. The base oxide film may prevent metal atoms from being released from the piezoelectric film 8. When the metal film is released, piezoelectric characteristics of the piezoelectric film 8 may be degraded. Further, when the released metal atoms are mixed with the silicon layer 10A constituting the vibration film 10, the durability of the vibration film 10 may be degraded.

Next, a lower electrode film as a material film of the lower electrode 7 is formed on the silicon oxide layer 10B (or on the base oxide film in a case in which the base oxide film is formed) (S2). The lower electrode film is configured as a Pt/Ti laminated film including a Ti film (e.g., with thickness ranging from 100 to 400) as a lower layer and a Pt film (e.g., having a thickness ranging from 1000 to 4000) as an upper layer. The lower electrode film may be formed through a sputtering method.

Thereafter, a material film (piezoelectric material film) of the piezoelectric film 8 is formed on an entire surface of the lower electrode film (S3). Specifically, for example, a PZT film having a thickness ranging from 1 μm to 5 μm is formed through a sol-gel method. In other words, a process of applying a material of PZT and performing preliminary firing on the same is repeatedly performed several times, and thereafter, a PZT film is formed through actual firing. The PZT film is formed of sintered compounds of metal oxide crystal grains.

Next, an upper electrode film as a material film of the upper electrode 9 is formed on an entire surface of the piezoelectric film 8 (S4). The upper electrode film is configured as an $Ir/IrO_2$ laminated film including an $IrO_2$ film (e.g., with a thickness ranging from 400 to 1600) as a lower layer and an Jr film (e.g., with a thickness ranging from 500 to 2000) as an upper layer. The upper electrode film may be formed through a sputtering method.

Next, the upper electrode film, the piezoelectric material film, and the lower electrode film are patterned (S5 to S 13). These patterning will be described in detail with reference to FIGS. 6A to 6C and 7A to 7D.

Figure 7A:
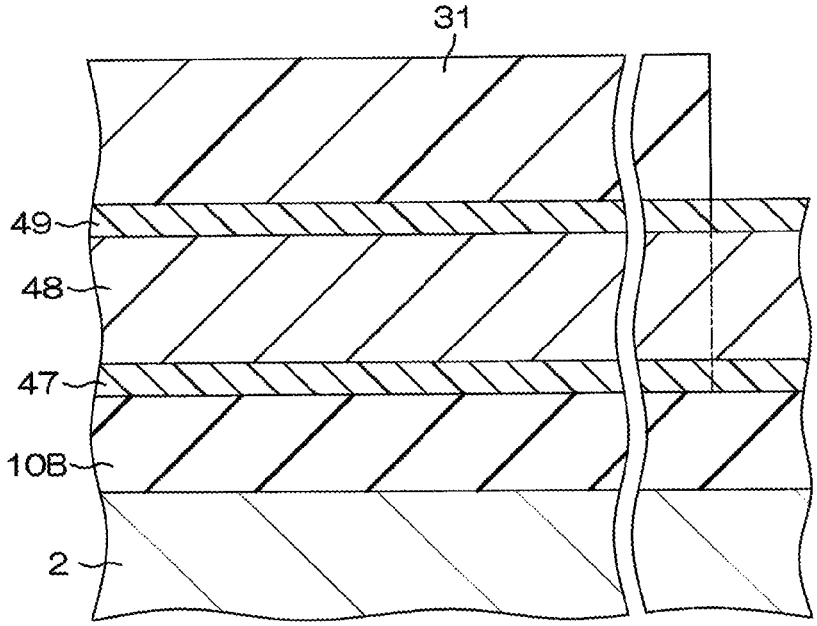
FIG. 7A is a cross-sectional view illustrating patterning of the lower electrode film, the piezoelectric material film, and the upper electrode film.

First, as illustrated in FIG. 7A, a resist mask 31 having a pattern for the lower electrode 7 is formed through photolithography (S5). The upper electrode film 49, the piezoelectric material film 48, and the lower electrode film 47 are etched to have the same pattern by using the resist mask 31 as a mask (S6 to S8). To be more specific, the upper electrode film 49 is patterned through dry etching (S6). The piezoelectric material film 48 is patterned through wet etching (S7). The lower electrode film 47 is etched through dry etching (S8). In this manner, the lower electrode 7 is formed.

Figure 6A:
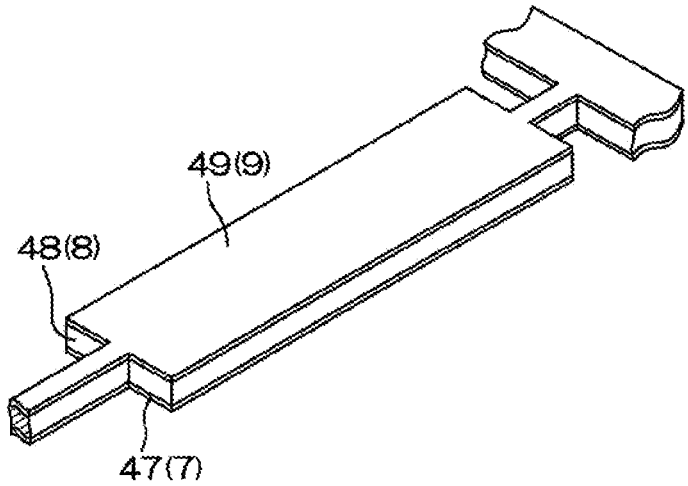
FIGS. 6A to 6C are perspective views illustrating patterning of a lower electrode film, a piezoelectric material film, and an upper electrode film.

An etchant used for performing wet etching on the piezoelectric material film 48 may be acids having hydrochloric acid as a main acid. The piezoelectric material film 48 is sintered compounds of crystal grains, and therefore, the crystal grains are separated or separated crystal grains are further re-attached during the etching operation. For this reason, an end surface 48*a* (see FIG. 7B) of the piezoelectric material film 48 after etching has depressions and protrusions resulting from the crystal grains. In this process, as illustrated in FIG. 6A, the piezoelectric material film 48 and the upper electrode film 49 are formed to have the same pattern as that of the lower electrode 7, and end surfaces thereof are almost perpendicular to main surfaces of the respective films 48 and 49 and the lower electrode 7.

Figure 6B:
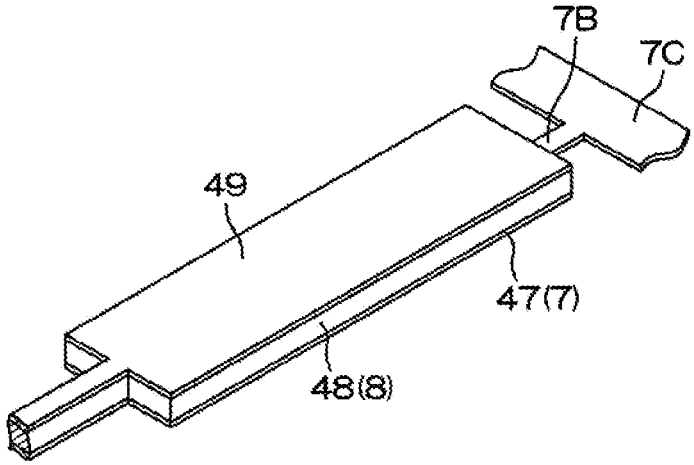
Figure 7B:
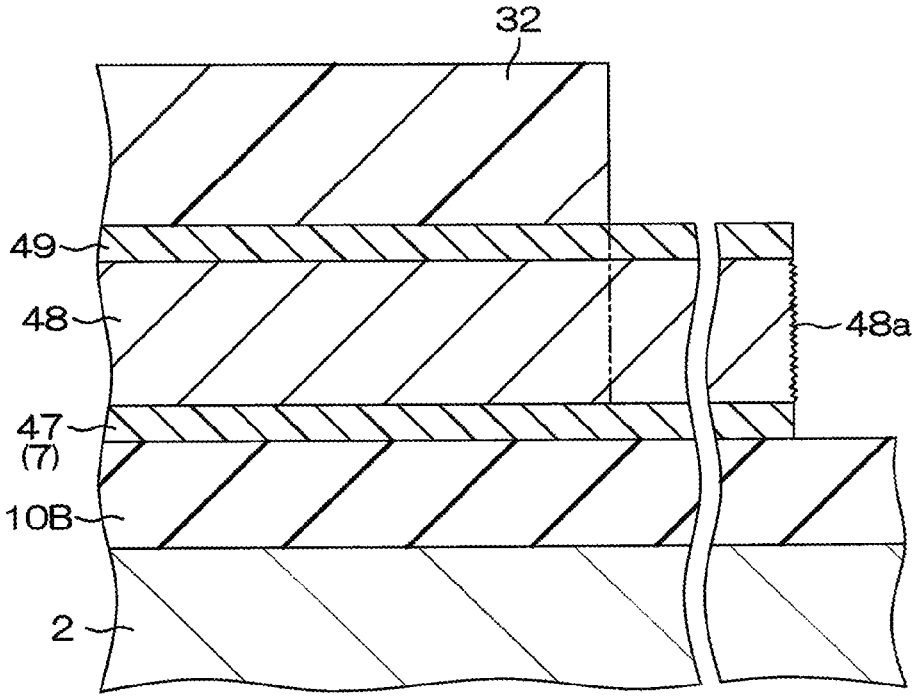
FIG. 7B is a cross-sectional view illustrating patterning of the lower electrode film, the piezoelectric material film, and the upper electrode film.

Next, after the resist mask 31 is removed, as illustrated in FIG. 7B, a resist mask 32 having a pattern for the piezoelectric film 8 is formed through photolithography (S9). The upper electrode film 49 and the piezoelectric material film 48 are etched to have the same pattern by using the resist mask 32 (S10 and S11). More specifically, the upper electrode film 49 is patterned through dry etching (S10). The piezoelectric material film 48 is patterned through wet etching (S11). In this manner, the piezoelectric film 8 is formed. Also, in this case, an end surface 48*c* (see FIG. 7C) of the piezoelectric material film 48 after etching has depressions and protrusions resulting from the crystal grains. In this process, as illustrated in FIG. 6B, the piezoelectric film 8 and the upper electrode 9 are formed to have the same pattern, and the piezoelectric material film 48 and the upper electrode film 49 on the lead-out electrode portion 7B and the common connection portion 7C are removed. End surfaces of the respective films are almost perpendicular to the main surfaces of the respective films.

Figure 7C:
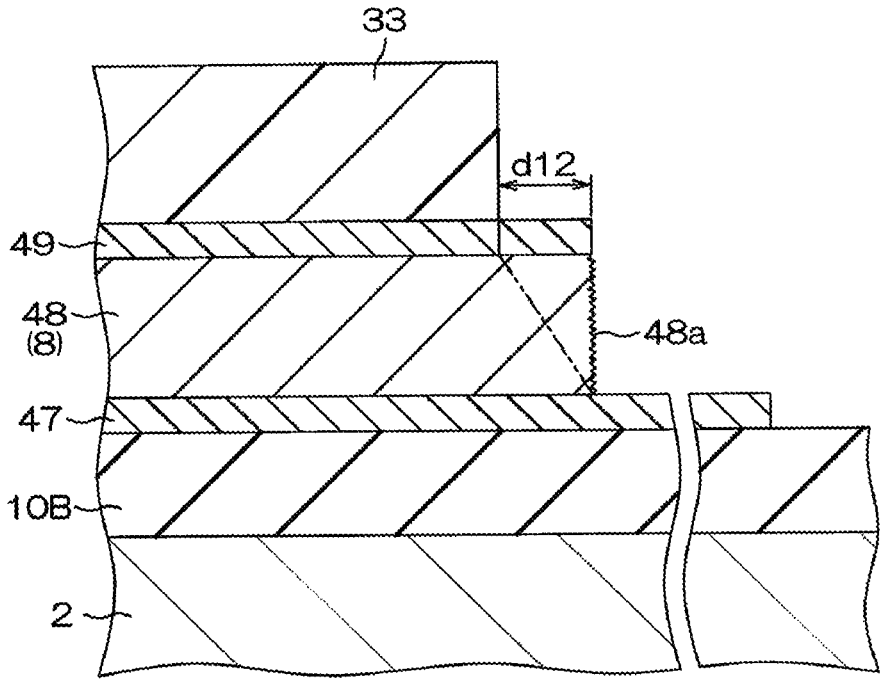
FIG. 7C is a cross-sectional view illustrating patterning of the lower electrode film, the piezoelectric material film, and the upper electrode film.

Next, after the resist mask 32 is removed, as illustrated in FIG. 7C, a resist mask 33 having a pattern for the upper electrode 9 is formed through photolithography (S12). The upper electrode film 49 is etched by using the resist mask 33 (S13). Accordingly, the upper electrode 9 is formed. More specifically, the upper electrode film 49 is patterned through dry etching. The resist mask 33 is formed as a pattern having a periphery receding by a predetermined distance d12 from the end surface of the piezoelectric film 8.

Figure 7D:
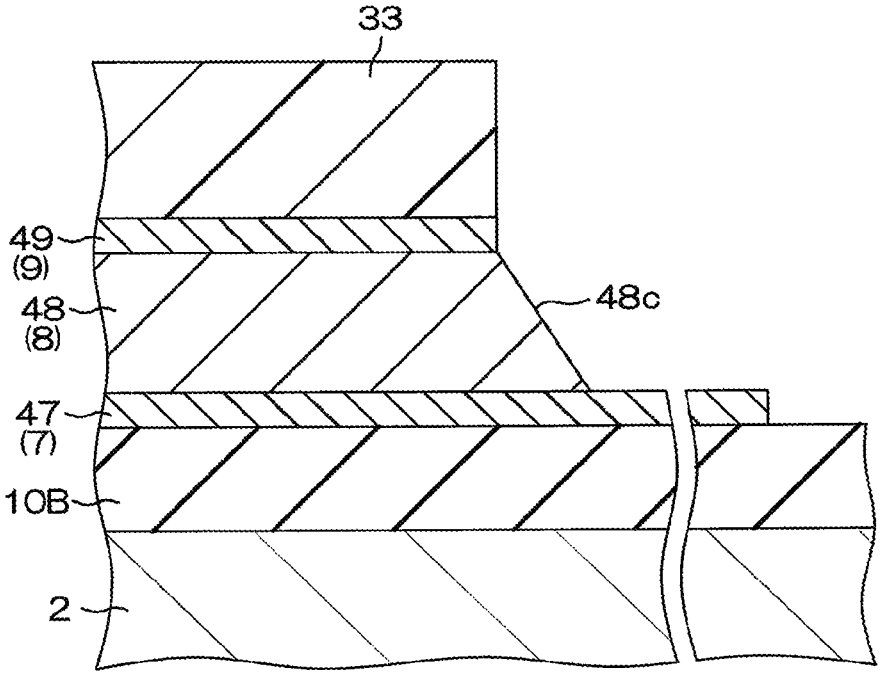
FIG. 7D is a cross-sectional view illustrating patterning of the lower electrode film, the piezoelectric material film, and the upper electrode film.

After the exposed portion of the upper electrode film 49 is removed through dry etching and patterned into the upper electrode 9, over-etching is performed by continuously performing dry etching, and a peripheral region of the piezoelectric film 8 that is exposed from the upper electrode 9 is etched. Accordingly, the end surface of the piezoelectric film 8 is processed and shaped as the smooth end surface 8*c* having a tapered shape as illustrated in FIG. 7D. In etching the upper electrode film 49, an etching rate of the piezoelectric film 8 is lower than that of the upper electrode film 49. In order to avoid the peripheral portion of the piezoelectric film 8 from being completely lost, the peripheral portion of the piezoelectric film 8 is gently processed.

Figure 6C:
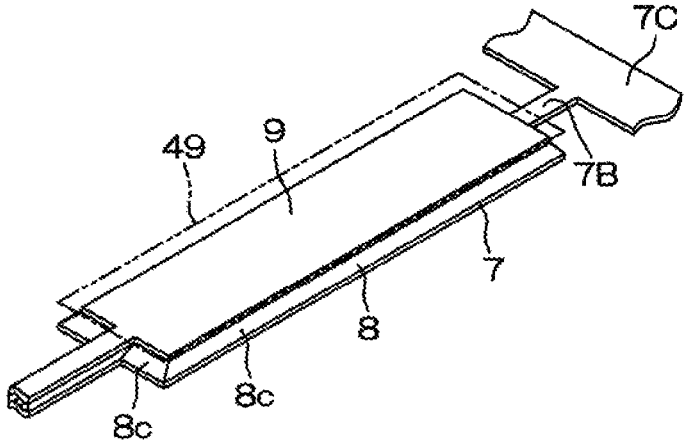

In this manner, as illustrated in FIG. 6C, the piezoelectric element 6 having a structure in which the piezoelectric film 8 shaped to have a mesa form is sandwiched between the lower electrode 7 and the upper electrode 9 is obtained. In FIG. 6C, an outer periphery of the upper electrode film 49 before being etched to have a pattern smaller than the piezoelectric film 8 is indicated by one long and two short dashed line.

Next, after the resist mask 33 is removed, a hydrogen barrier film 13 covering the entire surface is formed (S 14). The hydrogen barrier film 13 may be an $Al_2O_3$ film formed through a sputtering method and may have a film thickness ranging from approximately 400 to 1600.

Further, a surface protective film 15 covering the hydrogen barrier film 13 is formed (S15). The surface protective film 15 may be an oxide film (e.g., non-doped silicate glass (NSG) of plasma TEOS (Tetra Ethyl Ortho Silicate)) and have a film thickness ranging from 2500 to 10000.

Next, polishing is performed on a rear surface of the silicon substrate 2 to reduce the thickness of the silicon substrate 2 (S16). For example, the silicon substrate 2 with a thickness of about 670 μm in an initial state may become thinner, with a thickness of about 300 μm.

Thereafter, through the etching (dry etching or wet etching) performed on the rear surface of the silicon substrate 2, the pressure chamber 5 is formed, and at the same time, the silicon layer 10A constituting the vibration film 10 is formed (S17). During this etching, the hydrogen barrier film 13 and the base oxide film formed on the surface of the silicon oxide layer 10B prevent metal elements (Pb, Zr, and Ti in case of PZT) from being released from the piezoelectric film 8, to allow the piezoelectric film 8 to have excellent piezoelectric characteristics. Also, as mentioned above, the base oxide film formed on the surface of the silicon oxide layer 10B contributes to maintaining the durability of the silicon layer 10A forming the vibration film 10.

The piezoelectric film 8 and the pressure chamber 5 are formed such that the both end portions of the equal width rectangular portion 8A of the piezoelectric film 8 are positioned at an outer side than the both end portions of the vibration film 10 in the length direction and the interval dl is provided between the equal width rectangular portion 8A and the lateral side of the vibration film 10.

As described above, according to the present embodiment, the periphery of the upper electrode 9 recedes inwardly relative to the periphery of the piezoelectric film 8. The piezoelectric film 8 has the end surface 8*c* of a tapered shape. Accordingly, a distance from the upper electrode 9 to the lower electrode 7 is increased. Further, during dry etching performed to pattern the upper electrode 9 such that it has a pattern receding inwardly relative to the periphery of the piezoelectric film 8, depressions and protrusions of the end surface 48*a* of the piezoelectric material film 48 are reduced to provide the smooth end surface 8*c*. Thus, when a driving voltage (e.g., 30V to 40V) is applied between the upper electrode 9 and the lower electrode 7, a generation of spark (short circuit) therebetween can be prevented.

Figure 9A:
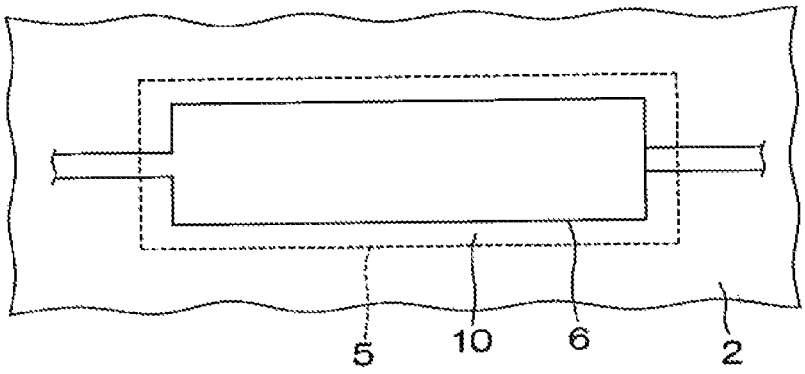
FIGS. 9A and 9B are views illustrating a configuration of a comparative example.
Figure 9B:
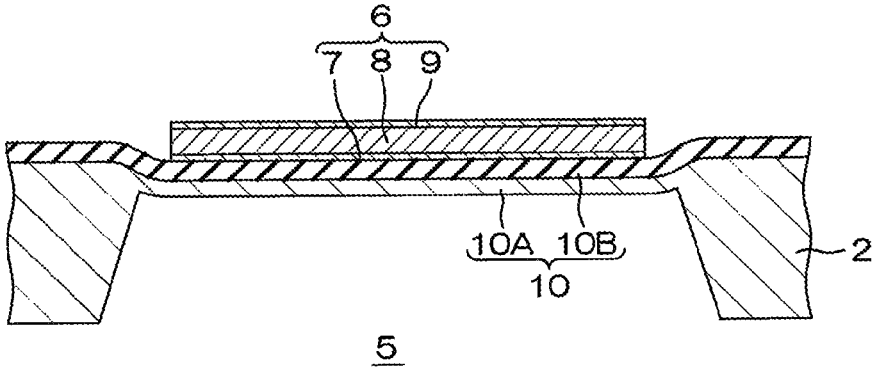

Further, in this embodiment, the piezoelectric film 8 extends to be longer than the corresponding vibration film 10 with respect to the length direction of the vibration film 10. Both end portions thereof reach an outer side relative to both end portions of the vibration film 10 so as to be positioned at the outer side of the pressure chamber 5. Through this configuration, the vibration film 10 may be prevented from being significantly bent due to a weight of the piezoelectric film 8. In the comparative example illustrated in FIGS. 9A and 9B, when one end portion or both end portions of the piezoelectric film 8 are positioned at an inner side relative to the end portion of the vibration film 10 (the end portion of the pressure chamber 5), the vibration film 10 is bent toward the center of the pressure chamber 5 due to the weight of the piezoelectric film 8. Then, a change in the volume of the pressure chamber 5 made when the piezoelectric film 8 is driven by applying a voltage between the upper electrode 9 and the lower electrode 7 is reduced to degrade ink discharge performance. In comparison, according to the configuration of the foregoing embodiment in which the end portion of the piezoelectric film 8 extends to an outer side of the vibration film 10, beyond the end portion of the vibration film 10 (the end portion of the pressure chamber 5), the piezoelectric film 8 on the vibration film 10 can be maintained by rigidity thereof since the both end portions of the piezoelectric film 8 are supported by the thick portion of the silicon substrate 2. Thus, a degree of bending of the vibration film 10 is reduced when not driven. Accordingly, when a driving voltage is applied between the upper electrode 9 and the lower electrode 7, the vibration film 10 is greatly displaced to increase a change in the volume of the pressure chamber 5. As a result, ink discharge performance can be enhanced.

In particular, in the piezoelectric film 8 of the present embodiment, the equal width rectangular portion 8A constituting the piezoelectric element 6 is positioned at an outer side of the corresponding vibration film 10, beyond the both end portions of the vibration film 10 in the length direction. Thus, bending of the vibration film 10 resulting from the weight of the piezoelectric film 8 can be effectively reduced. As a result, the volume of the pressure chamber 5 can be greatly varied to further enhance ink discharge performance.

Further, in this embodiment, the both end portions of the lower electrode 7 and the upper electrode 9 constituting the piezoelectric element 6 are disposed at an outer side than the both end portions of the vibration film 10 in the length direction, like the piezoelectric film 8. Thus, since the piezoelectric element 6 is entirely supported by the thick portion of the silicon substrate 2 outside the pressure chamber 5, bending of the vibration film 10 when not driven can be more effectively reduced.

In addition, according to this embodiment, the internal dl is provided between the periphery of the piezoelectric film 8 (the periphery of the piezoelectric element 6 in this embodiment) and the lateral side according to the length direction of the vibration film 10. Thus, when the piezoelectric element 6 is driven, the vibration film 10 can be greatly deformed in the region of the space between the periphery of the piezoelectric film 8 (the periphery of the piezoelectric element 6) and the lateral side according to the length direction of the vibration film 10. Thus, the volume of the pressure chamber 5 can be greatly varied to contribute to enhancement of the ink discharge performance.

Figure 8:
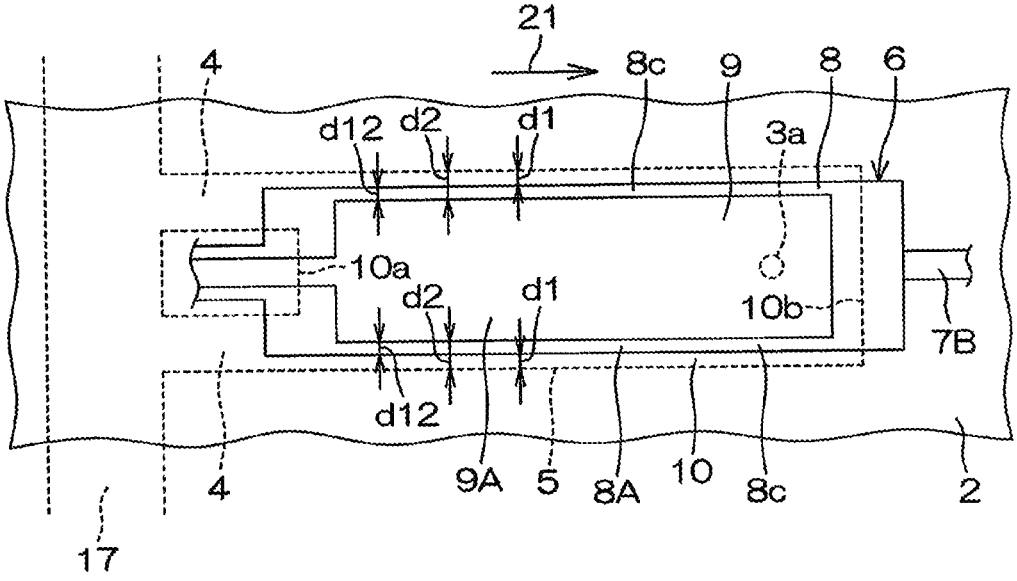
FIG. 8 is a schematic plan view illustrating a configuration of an ink jet print head according to another embodiment of the present disclosure.

So far, the first embodiment of the present disclosure has been described, but the present disclosure may be further implemented in a different form. For example, in the foregoing embodiment, the respective equal width rectangular portions 7A, 8A, and 9A of the lower electrode 7, the piezoelectric film 8, and the upper electrode 9 constituting the piezoelectric element 6 extend to an outer side (an outer side of the pressure chamber 5) of the vibration film 10 beyond both ends of the vibration film 10, such that they are all longer than the vibration film 10. However, as illustrated in FIG. 8, the equal width rectangular portion 9A of the upper electrode 9 may be shorter than the vibration film 10 and both end sides thereof may be positioned at an inner side of the both end sides 10*a* and 10*b* of the vibration film 10 in the length direction (an inner side of the pressure chamber 5 when viewed from the plane). With this configuration, when a driving voltage is applied between the lower electrode 7 and the upper electrode 9, the piezoelectric film 8 may be deformed in a region within the vibration film 10. Thus, the vibration film 10 can be effectively and greatly deformed, and thus, the volume of the pressure chamber 5 can be further greatly varied. Accordingly, the ink discharge performance can be further enhanced. In order to fabricate such a structure, the piezoelectric film 8, the upper electrode 9, and the pressure chamber 5 may be formed such that both end portions of the equal width rectangular portion 8A of the piezoelectric film 8 are positioned at an outer side than both end portions of the vibration film 10 in the length direction and the both end portions of the upper electrode 9 are formed to be positioned at an inner side of the vibration film 10 in the length direction.

Further, in the foregoing embodiment, PZT is illustrated as a material of the piezoelectric film, but a piezoelectric material made of a metal oxide represented by $PbPO_3$, $KNbO_3$, $LiNbO_3$, $LiTaO_3$, or the like may also be applied.

In addition, in the foregoing embodiment, the vibration film 10 includes the silicon layer 10A as a portion of the silicon substrate 2 having the pressure chamber 5, but the vibration film 10 may be configured by using only a film material different from that of the silicon substrate 2.

Also, besides silicon, a substrate material such as glass may also be used as a material of the substrate 2.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. An ink jet print head, comprising:

a substrate in which a pressure chamber is formed;

a vibration film configured to define the pressure chamber and deformed to change a volume of the pressure chamber;

a lower electrode formed on the vibration film;

a piezoelectric film formed on the lower electrode; and an upper electrode formed on the piezoelectric film and having a periphery receding inwardly relative to a periphery of the piezoelectric film;

wherein a width of the lower electrode is shorter than a width of the pressure chamber;

wherein the vibration film has a rectangular shape; and wherein the piezoelectric film is longer than the vibration film with respect to a length direction of the vibration film, and an end portion of the piezoelectric film extends to an outer side of the vibration film, beyond an end portion of the vibration film in the length direction.

2. The ink jet print head of claim 1, wherein the piezoelectric film has an end surface having a tapered shape receding inwardly toward the upper electrode from the lower electrode.

3. The ink jet print head of claim 1, wherein the piezoelectric film is configured as sintered compounds of metal oxide crystal grains.

4. The ink jet print head of claim 1, wherein; the piezoelectric film has an equal width rectangular portion extending in the length direction of the vibration film; and the equal width rectangular portion is longer than the length of the vibration film in the length direction, and both end portions of the equal width rectangular portion are positioned at an outer side of the vibration film, beyond both end portions of the vibration film in the length direction.

5. The ink jet print head of claim 1, wherein: the upper electrode is shorter than the vibration film with respect to the length direction of the vibration film; and an end portion of the upper electrode is disposed at an inner side of the vibration film, relative to both end portions of the vibration film in the length direction.

6. The ink jet print head of claim 1, wherein: a space is provided between the periphery of the piezoelectric film and a lateral side along the length direction of the vibration film.

7. A method for fabricating an ink jet print head, comprising:

preparing a substrate;

forming a lower electrode film on the substrate;

forming a piezoelectric material film laminated on the lower electrode film;

forming an upper electrode film laminated on the piezoelectric material film;

patterning the lower electrode film, the piezoelectric material film, and the upper electrode film by a lower electrode pattern to form a lower electrode;

patterning the upper electrode film and the piezoelectric material film by a piezoelectric film pattern different from the lower electrode pattern to form a piezoelectric film;

patterning the upper electrode film by an upper electrode pattern having a periphery receding inwardly from a periphery of the piezoelectric film to form an upper electrode; and etching portions of the substrate facing the lower electrode, the piezoelectric film, and the upper electrodes from an opposite side of the piezoelectric film to form a pressure chamber facing the lower electrode, the piezoelectric film, and the upper electrode, and forming a vibration film made of a portion of the substrate between the lower electrode and the pressure chamber;

wherein the vibration film has a rectangular shape; and wherein the piezoelectric film is longer than the vibration film with respect to a length direction of the vibration film, and an end portion of the piezoelectric film extends to an outer side of the vibration film, beyond an end portion of the vibration film in the length direction.

8. The method of claim 7, wherein, in patterning the upper electrode film by the upper electrode film pattern, an end surface of the piezoelectric film is shaped as a tapered surface receding inwardly toward the upper electrode from the lower electrode.

9. The method of claim 7, wherein the piezoelectric film is configured as sintered compounds of metal oxide crystal grains.

10. The method of claim 7, wherein the vibration film has a rectangular shape, and the piezoelectric film and the pressure chamber are formed such that the piezoelectric film is longer than the vibration film with respect to a length direction of the vibration film, and an end portion of the piezoelectric film extends to an outer side of the vibration film, beyond an end portion of the vibration film in the length direction.

11. The method of claim 10, wherein the upper electrode and the pressure chamber are formed such that the upper electrode is shorter than the vibration film with respect to the length direction of the vibration film, and an end portion of the upper electrode is disposed at an inner side of the vibration film, relative to both end portions of the vibration film in the length direction.

12. The method of claim 10, wherein the piezoelectric film and the pressure chamber are formed such that a space is provided between the periphery of the piezoelectric film and a lateral side along the length direction of the vibration film.

* * * * *